US009205306B2

(12) United States Patent
Watanabe

(10) Patent No.: US 9,205,306 B2
(45) Date of Patent: Dec. 8, 2015

(54) MULTI-PIECE SOLID GOLF BALL

(75) Inventor: Hideo Watanabe, Chichibushi (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 706 days.

(21) Appl. No.: 13/439,062

(22) Filed: Apr. 4, 2012

(65) Prior Publication Data

US 2013/0267347 A1 Oct. 10, 2013

(51) Int. Cl.
*A63B 37/06* (2006.01)
*A63B 37/00* (2006.01)

(52) U.S. Cl.
CPC ..... *A63B 37/0045* (2013.01); *A63B 37/0003* (2013.01); *A63B 37/0051* (2013.01); *A63B 37/0076* (2013.01); *A63B 37/0092* (2013.01); *A63B 37/002* (2013.01); *A63B 37/0006* (2013.01); *A63B 37/0007* (2013.01); *A63B 37/008* (2013.01); *A63B 37/0016* (2013.01); *A63B 37/0018* (2013.01); *A63B 37/0019* (2013.01); *A63B 37/0021* (2013.01); *A63B 37/0022* (2013.01); *A63B 37/0081* (2013.01); *A63B 37/0084* (2013.01); *A63B 37/0096* (2013.01)

(58) Field of Classification Search
CPC ..... A63B 37/0062; A63B 37/0076
USPC ..... 473/376, 373, 374
See application file for complete search history.

(56) References Cited

U.S. PATENT DOCUMENTS

| | | | | |
|---|---|---|---|---|
| 4,017,228 | A | 4/1977 | Cereijo et al. | |
| 5,743,816 | A * | 4/1998 | Ohsumi et al. | 473/376 |
| 5,782,707 | A | 7/1998 | Yamagishi et al. | |
| 6,194,505 | B1 | 2/2001 | Sone et al. | |
| 6,642,314 | B2 | 11/2003 | Sone et al. | |
| 6,679,791 | B2 | 1/2004 | Watanabe | |
| 6,849,006 | B2 | 2/2005 | Cavallaro et al. | |
| 6,855,074 | B2 | 2/2005 | Kato | |
| 6,913,547 | B2 | 7/2005 | Cavallaro et al. | |
| 6,966,849 | B2 | 11/2005 | Kato | |
| 7,086,969 | B2 | 8/2006 | Higuchi et al. | |
| 7,153,224 | B2 | 12/2006 | Higuchi et al. | |
| 7,294,680 | B2 | 11/2007 | Sone et al. | |
| 7,708,656 | B2 * | 5/2010 | Sullivan et al. | 473/376 |
| 8,123,631 | B2 * | 2/2012 | Sullivan et al. | 473/376 |
| 2010/0075780 | A1 * | 3/2010 | Sullivan et al. | 473/376 |

FOREIGN PATENT DOCUMENTS

| | | | |
|---|---|---|---|
| JP | 11-35633 | A | 2/1999 |
| JP | 11-164912 | A | 6/1999 |
| JP | 2002-293996 | A | 10/2002 |

* cited by examiner

*Primary Examiner* — Raeann Gorden

(74) *Attorney, Agent, or Firm* — Sughrue Mion, PLLC

(57) ABSTRACT

The invention provides a multi-piece solid golf ball having a solid core with a spherical first layer, a second layer encasing the first layer and a third layer encasing the second layer, and having also an intermediate layer and a cover which encase the solid core. The first to third layers of the solid core are each respectively formed of a rubber composition. The ball has optimized relationships among the cross-sectional hardness at the center of the first layer obtained by cutting the solid core in half, the surface hardnesses of the first to third layers, and the respective hardnesses of the intermediate layer and the cover. The golf ball has an increased distance on full shots with a driver and an improved controllability in the short game, and on full shots also confers an agreeable feel at impact characterized by a solid sensation that includes a soft touch.

7 Claims, 2 Drawing Sheets

MULTI-PIECE SOLID GOLF BALL

BACKGROUND OF THE INVENTION

The present invention relates to a multi-piece solid golf ball having a solid core with a multilayer construction that includes a spherical first layer, a second layer encasing the first layer, and a third layer encasing the second layer, and having an intermediate layer and a cover which encase the solid core. More specifically, the invention relates to a golf ball which can be suitably used for play on a golf course, has both a flight performance and controllability capable of satisfying the professional golfer and the skilled amateur golfer, and moreover provides the utmost in "feel" on full shots.

Golf balls are commonly designed with a multilayer structure so as to increase the distance traveled by the ball and improve the feel of the ball when struck. Such designs are often augmented by providing not only the cover, but also the core with a structure of two or more layers for the purpose of lowering the spin rate, increasing the initial velocity and further enhancing the feel at impact. Various multi-piece golf balls embodying such design innovations and improvements are described in the art.

Golf balls which have a somewhat soft cover, an intermediate layer formed of an ionomer material that is relatively hard compared with the cover, and a solid core of a one- or two-layer construction that is composed of rubber or a resin material are currently in wide use among professional golfers and skilled amateur golfers as balls endowed with both an excellent flight performance and excellent controllability. Such balls, by combining a somewhat soft cover with a hard, high-resilience intermediate layer made of an ionomer material, manifest a high controllability in the short game and moreover, on full shots with a driver, suppress excess spin and exhibit a high rebound. Also, the spin rate on full shots is controlled by providing the solid core with a one- or two-layer construction.

Such golf balls include those having a solid core with a two-layer construction and a cover which are disclosed in, for example, U.S. Pat. Nos. 6,679,791, 5,782,707, 7,153,224, 7,086,969, 6,913,547, 6,849,006 and 4,017,228, and also those having a solid core with a three-layer construction which are disclosed in U.S. Pat. Nos. 6,855,074 and 6,966,849. However, all of these conventional golf balls lack a sufficient initial velocity on shots with a driver (W#1) or do not have a good feel at impact. Hence, further improvement has been desired.

SUMMARY OF THE INVENTION

It is therefore an object of the invention to provide a multi-piece solid golf ball which, as a golf ball for professional golfers and skilled amateur golfers, achieves in particular an increased distance on full shots with a driver (W#1) and an improved controllability in the short game, and on full shots also confers an agreeable feel at impact characterized by a solid sensation that includes a soft touch.

As a result of extensive investigations aimed at achieving the above objects, the inventor has discovered that, in a multi-piece solid golf ball having a solid core with a multilayer construction that includes a spherical first layer, a second layer encasing the first layer and a third layer encasing the second layer, and having an intermediate layer and a cover which encase the solid core, by optimizing the hardness relationships among the first to third layers and also optimizing the hardness relationship between the intermediate layer and the cover, it is possible to improve both the flight performance on shots with a driver (W#1) and the controllability on approach shots and also to obtain the agreeable feel at impact described above.

Accordingly, the invention provides the following multi-piece solid golf balls.

[1] A multi-piece solid golf ball comprising a solid core having a spherical first layer, a second layer encasing the first layer and a third layer encasing the second layer, and an intermediate layer and a cover which encase the solid core, wherein the first to third layers of the solid core are each respectively formed of a rubber composition; letting (a) represent a JIS-C cross-sectional hardness at a center of the first layer on a cross-section obtained by cutting the solid core in half, (b) represent a JIS-C surface hardness of the first layer, (c) represent a JIS-C surface hardness of the second layer and (d) represent a JIS-C surface hardness of the third layer, the hardnesses (a) to (d) satisfy the condition cross-sectional hardness ($a$)<surface hardness ($b$)<surface hardness ($c$)>surface hardness ($d$);

and the intermediate layer and the cover have Shore D material hardnesses which satisfy the condition intermediate layer>cover.

[2] The multi-piece solid golf ball of [1], wherein the third layer has a thickness of not more than 3 mm.

[3] The multi-piece solid golf ball of [1], wherein the cross-sectional hardness (a) and the surface hardness (b) satisfy the condition $5 \leq$ surface hardness ($b$) − cross-sectional hardness ($a$) $\leq 20$.

[4] The multi-piece solid golf ball of [1], wherein the surface hardness (c) and the cross-sectional hardness (a) satisfy the condition $21 \leq$ surface hardness ($c$) − cross-sectional hardness ($a$) $\leq 50$.

[5] The multi-piece solid golf ball of [1], wherein the surface hardness (c) and the surface hardness (d) satisfy the condition $-20 \leq$ surface hardness ($d$) − surface hardness ($c$) $\leq -1$.

[6] The multi-piece solid golf ball of [1], wherein an organosulfur compound is included in each of the rubber compositions that form the first to third layers, the organosulfur compound being included in amounts which satisfy the condition first layer>second layer>third layer.

[7] The multi-piece solid golf ball of [1], wherein zinc acrylate is included in each of the rubber compositions that form the first to third layers, the zinc acrylate being included in amounts which satisfy the condition first layer<second layer>third layer.

BRIEF DESCRIPTION OF THE DIAGRAM

DETAILED DESCRIPTION OF THE INVENTION

Figure 1:
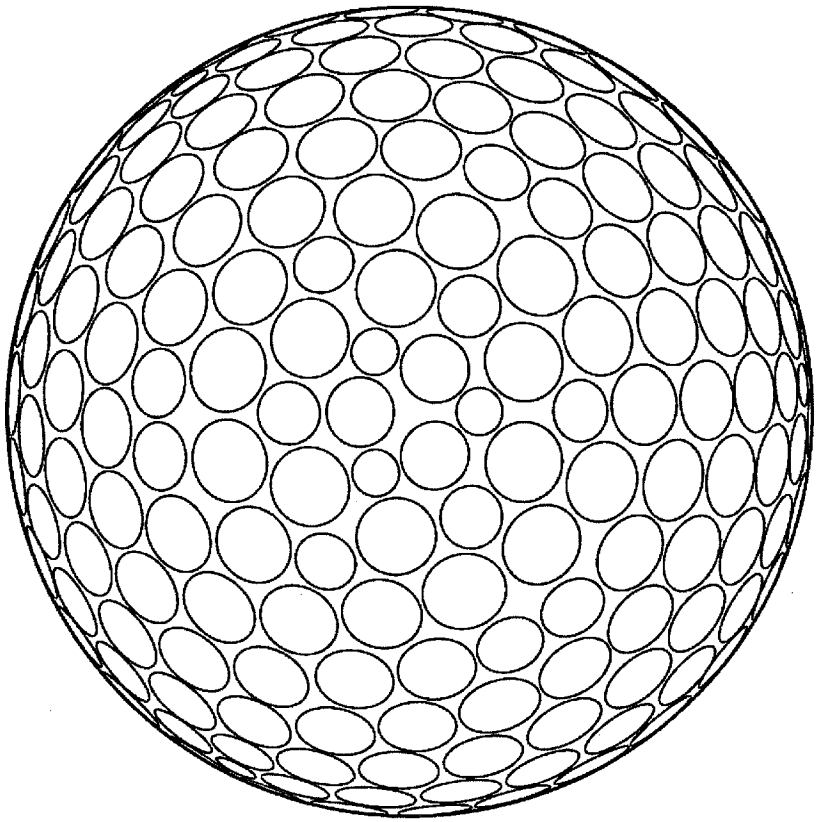
FIG. 1 is a plan view showing the dimple pattern used on balls in the examples of the invention.
Figure 2:
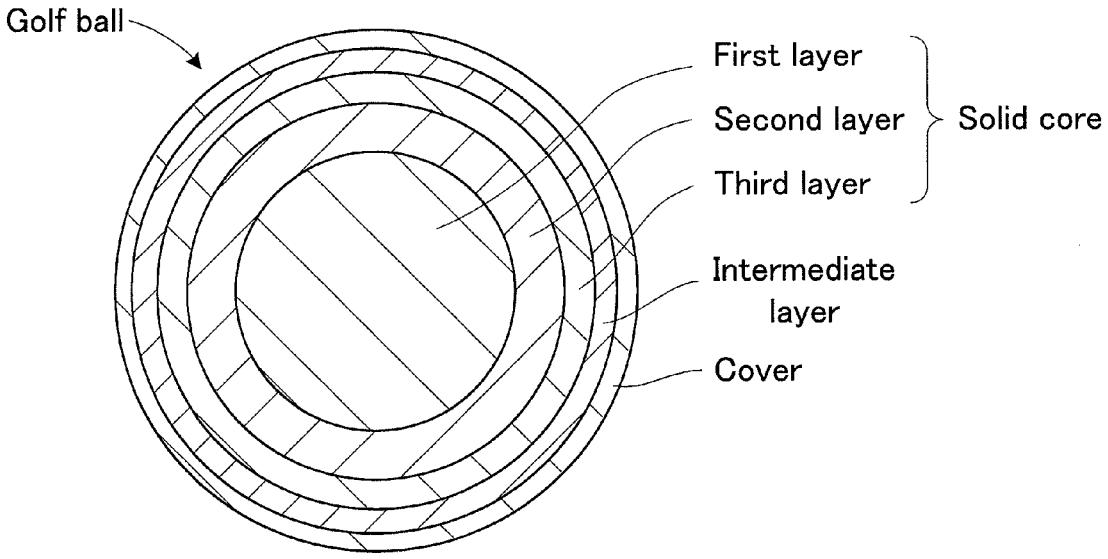
FIG. 2 is a schematic cross-sectional view showing the multi-piece solid golf ball having a solid core with a multilayer construction that includes a spherical first layer, a second layer encasing the first layer, and a third layer encasing the second layer, and having an intermediate layer and a cover encasing the solid core.

The present invention is described more fully below.

The multi-piece solid golf ball of the invention, although not shown in an accompanying diagram, is composed of a solid core having a multilayer construction that includes a spherical first layer, a second layer encasing the first layer and a third layer encasing the second layer, and an intermediate layer and a cover which encase the solid core.

First, the hardness relationships among the first to third layers of the solid core are optimized so that, letting (a) represent a JIS-C cross-sectional hardness at a center of the first layer on a cross-section obtained by cutting the solid core in half, (b) represent a JIS-C surface hardness of the first layer, (c) represent a JIS-C surface hardness of the second layer and (d) represent a JIS-C surface hardness of the third layer, the hardnesses (a) to (d) satisfy the condition cross-sectional hardness (*a*)<surface hardness (*b*)<surface hardness (*c*)>surface hardness (*d*).

The layers of the solid core are each described in detail below.

The first layer is the layer situated on the innermost side of the solid core, and is spherical. The cross-sectional hardness (a) at the center of this first layer, although not subject to any particular limitation, may be set to a value, expressed as the JIS-C hardness, of at least 30, preferably at least 40, and more preferably at least 50. The maximum JIS-C hardness value, although not subject to any particular limitation, may be set to not more than 65, preferably not more than 60, and even more preferably not more than 55. If this cross-sectional hardness (a) is too low, the rebound may be too low and an increased distance may not be achieved, the feel on impact may be too soft, or the durability to cracking when repeatedly struck may worsen. On the other hand, if the cross-sectional hardness (a) is too high, the spin rate may rise excessively and an increased distance may not be achieved, or the feel on impact may be too hard.

The surface hardness (b) of the first layer, although not subject to any particular limitation, may be set to a value, expressed as the JIS-C hardness, of preferably at least 50, more preferably at least 55, and even more preferably at least 60. The maximum JIS-C hardness value, although not subject to any particular limitation, may be set to preferably not more than 80, more preferably not more than 75, and even more preferably not more than 70. If the surface hardness (b) is too low, the rebound may be too low and a good distance may not be achieved, the feel on impact may be too soft, or the durability to cracking when repeatedly struck may worsen. On the other hand, if the surface hardness (b) is too high, the feel on impact may become too high or the durability to cracking when repeatedly struck may worsen.

The diameter of the first layer, although not subject to any particular limitation, is preferably set to from 15 to 28 mm. In this case, the minimum value in the diameter is more preferably at least 16 mm, and even more preferably at least 17 mm. The maximum value in the diameter, although not subject to any particular limitation, is more preferably not more than 26 mm, and even more preferably not more than 24 mm. If the diameter of the first layer is too small, the spin rate lowering effect on full shots may be inadequate, as a result of which the spin rate may become too high and an increased distance may not be achieved. On the other hand, if the diameter is too large, the durability to cracking when repeatedly struck may worsen. Also, the core deflection may become too large, leading to a larger deflection of the overall ball, as a result of which the initial velocity when struck may decrease and a good distance may not be achieved.

The deflection of the first layer when compressed under a final load of 1,275 N (130 kgf) from an initial load of 98 N (10 kgf), although not subject to any particular limitation, is preferably at least 4 mm, more preferably at least 5 mm, and even more preferably at least 6 mm. The maximum value, although not subject to any particular limitation, is preferably not more than 10 mm, more preferably not more than 8 mm, and even more preferably not more than 7 mm. If the deflection is too large, the ball rebound may become so small that a good distance is not achieved, the feel on impact may become too soft, or the durability to cracking when repeatedly struck may worsen. On the other hand, if the deflection is too small, the spin rate may rise excessively so that a good distance is not achieved, or the feel on impact may become too hard.

The second layer is a layer which encases the first layer. Of the three layers making up the solid core, this is the layer situated in the middle.

The surface hardness (c) of the second layer, although not subject to any particular limitation, may be set to a value, expressed as the JIS-C hardness, of preferably at least 65, more preferably at least 68, and even more preferably at least 72. The maximum value, although not subject to any particular limitation, may be set to a JIS-C hardness value of preferably not more than 90, more preferably not more than 85, and even more preferably not more than 80. If the surface hardness (c) is too low, the ball rebound may become too low or the spin rate-lowering effect on full shots may be inadequate, as a result of which a good distance may not be achieved. On the other hand, if the surface hardness (c) is too high, the feel on impact may become too hard, or the durability to cracking when repeatedly struck may worsen.

The thickness of the second layer, although not subject to any particular limitation, is preferably set to from 3 to 15 mm. The lower limit in the thickness of the second layer is more preferably at least 5 mm, and even more preferably at least 7 mm. The upper limit in the thickness of the second layer is more preferably not more than 12 mm, and even more preferably not more than 10 mm. If the thickness of the second layer is too small, the spin rate-lowering effect on full shots may be inadequate, as a result of which a good distance may not be achieved, or the durability to cracking when repeatedly struck may worsen. On the other hand, if the thickness of the second layer is too large, the spin rate-lowering effect on full shots may be inadequate, as a result of which a good distance may not be achieved, or the durability to cracking when repeatedly struck may worsen.

The third layer is a layer which encases the second layer. Of the three layers making up the solid core, this is the layer situated on the outermost side.

The surface hardness (d) of the third layer, although not subject to any particular limitation, may be set to a value, expressed as the JIS-C hardness, of preferably at least 65, more preferably at least 68, and even more preferably at least 72. The maximum value, although not subject to any particular limitation, may be set to a JIS-C hardness value of preferably not more than 90, more preferably not more than 85, and even more preferably not more than 80. If the surface hardness (d) is too low, the ball rebound may become too low or the spin rate-lowering effect on full shots may be inadequate, as a result of which a good distance may not be achieved. On the other hand, if the surface hardness (d) is too high, the feel on impact may become too hard, or the durability to cracking when repeatedly struck may worsen.

The thickness of the third layer, although not subject to any particular limitation, is preferably set to from 0.5 to 3.0 mm. The lower limit in the thickness of the third layer is more preferably at least 1.0 mm, and even more preferably at least 1.2 mm. The upper limit in the thickness of the third layer is more preferably not more than 2.0 mm, and even more preferably not more than 1.8 mm. If the thickness of the third layer is too small, the solid sensation at impact on full shots may lack a soft touch. On the other hand, if the thickness of the third layer is too large, the spin rate-lowering effect on full shots may be inadequate, as a result of which a good distance may not be achieved, or the durability to cracking when repeatedly struck may worsen.

In the practice of the invention, it is critical for the above hardnesses (a) to (d) in the solid core having a three-layer construction to satisfy the following relationship: cross-sectional hardness (a)<surface hardness (b)<surface hardness (c)>surface hardness (d). When the hardnesses of the respective layers in the solid core do not satisfy the above relationship, it may not be possible to obtain an increase in distance, particularly on full shots with a driver (W#1), and an agreeable feel at impact on full shots which is characterized by a solid sensation that includes a soft touch. Also, although not subject to any particular limitation, above hardnesses (a) to (d) preferably satisfy the subsequently described conditions.

The surface hardness (c)–cross-sectional hardness (a) value, expressed in terms of JIS-C hardness, although not subject to any particular limitation, is preferably from 21 to 50. The lower limit of this value is more preferably at least 25, and even more preferably at least 28. The upper limit of this value is more preferably not more than 40, and even more preferably not more than 36. If the surface hardness (c)–cross-sectional hardness (a) value is too small, the spin rate-lowering effect on full shots may be inadequate, possibly resulting in a higher spin rate and a poor distance. On the other hand, if this value is too large, the durability to cracking when repeatedly struck may worsen.

The surface hardness (b)–cross-sectional hardness (a) value, although not subject to any particular limitation, is preferably from 5 to 20. The lower limit of this value is more preferably at least 7, and even more preferably at least 10. The upper limit of this value is more preferably not more than 17, and even more preferably not more than 15. If the surface hardness (b)–cross-sectional hardness (a) value is too small, the spin rate-lowering effect on full shots may be inadequate, possibly resulting in a higher spin rate and a poor distance. On the other hand, if this value is too large, the durability to cracking when repeatedly struck may worsen.

The surface hardness (d)–surface hardness (c) value, although not subject to any particular limitation, is preferably from −20 to −1. The lower limit of this value is more preferably at least −15, and even more preferably at least −10. The upper limit of this value is more preferably not more than −3, and even more preferably not more than −5. If the above (d)–(c) value is too large, the solid sensation at impact on full shots may lack a soft touch. This tendency becomes particularly striking when the foregoing value exceeds 0. On the other hand, if the (d)–(c) value is too small (too large in the negative direction), the spin rate may become too high, resulting in a poor distance, or the durability to cracking when repeatedly struck may worsen.

As noted above, by optimizing the hardnesses (a) to (d) of the respective layers making up the solid core, it is possible to obtain an excellent flight performance on shots with a driver (W#1), an excellent controllability on approach shots, and also an agreeable feel on impact. The above hardnesses (a) to (d) refer to the hardness values measured with a spring durometer (JIS type C), as specified in JIS K 6301-1975.

Each of the above first to third layers is formed using a rubber composition. In the present invention, although not subject to any particular limitation, particularly from the standpoint of obtaining a high rebound and an excellent flight performance, these layers are preferably formed using rubber compositions containing the subsequently described polybutadiene as the base rubber.

The polybutadiene is not subject to any particular limitation, although the use of a polybutadiene having on the polymer chain a cis-1,4 bond content of at least 60 wt %, preferably at least 80 wt %, more preferably at least 90 wt %, and most preferably at least 95 wt %, is recommended. If the cis-1,4 bond content among the bonds on the molecule is too small, the rebound may decrease.

The content of the 1,2-vinyl bonds included in the polybutadiene is not subject to any particular limitation, although it is recommended that the content on the polymer chain be preferably not more than 2 wt %, more preferably not more than 1.7 wt %, and even more preferably not more than 1.5 wt %. If the 1,2-vinyl bond content is too high, the rebound may decrease.

From the standpoint of obtaining a molded and vulcanized material having a good rebound, the polybutadiene is preferably one that that has been synthesized using a rare earth catalyst or a Group VIII metal compound catalyst, and most preferably one that has been synthesized using a rare earth catalyst. Also, where necessary, an organoaluminum compound, an alumoxane, a halogen-bearing compound, a Lewis base and the like may be used in combination with these catalysts. In this invention, it is preferable to use, as the various foregoing compounds, those mentioned in JP-A 11-35633.

In the invention, of the above rare earth catalysts, the use of a neodymium catalyst that employs a neodymium compound, which is a lanthanum series rare-earth compound, is especially recommended for obtaining a polybutadiene rubber having a high cis-1,4 bond content and a low 1,2-vinyl bond content at an excellent polymerization activity. Preferred examples of such rare-earth compounds include those mentioned in JP-A 11-35633, JP-A 11-164912 and JP-A 2002-293996.

Illustrative examples of such lanthanide series rare-earth compounds include halides, carboxylates, alcoholates, thioalcoholates and amides of atomic number 57 to 71 metals.

Although not subject to any particular limitation, from the standpoint of enhancing rebound, it is recommended that the content of the above polybutadiene in the base rubber be preferably at least 10 wt %, more preferably at least 20 wt %, and even more preferably at least 40 wt %.

In the present invention, rubbers other than the above polybutadiene may also be included, insofar as the objects of the invention are attainable. Illustrative examples include polybutadiene rubbers other than the above-described polybutadiene, styrene-butadiene rubbers, natural rubbers, isoprene rubbers and ethylene-propylene-diene rubbers. These may be used singly or as a combination of two or more types.

In the invention, additives such as the subsequently described co-crosslinking agents, organic peroxides, antioxidants, inert fillers and organosulfur compounds may be suitably blended with the above base rubber.

Illustrative examples of co-crosslinking agents include unsaturated carboxylic acids and metal salts of unsaturated carboxylic acids.

Suitable unsaturated carboxylic acids include, but are not particularly limited to, acrylic acid, methacrylic acid, maleic acid and fumaric acid. The use of acrylic acid or methacrylic acid is especially preferred.

Suitable metal salts of unsaturated carboxylic acids include, but are not particularly limited to, the above unsaturated carboxylic acids neutralized with a desired metal ion. Specific examples include the zinc salts and magnesium salts of methacrylic acid and acrylic acid. The use of zinc acrylate is especially preferred.

The amount of the co-crosslinking agent included in the rubber composition, although not subject to any particular limitation, may be set to preferably at least 5 parts by weight, more preferably at least 10 parts by weight, and even more preferably at least 15 parts by weight, per 100 parts by weight of the base rubber. The maximum co-crosslinking agent content per 100 parts by weight of the base rubber, although not subject to any particular limitation, may be set to preferably not more than 60 parts by weight, more preferably not more than 50 parts by weight, even more preferably not more than 45 parts by weight, and most preferably not more than 40 parts by weight. Too much co-crosslinking agent may make the ball too hard, resulting in an unpleasant feel on impact. On the other hand, too little co-crosslinking agent may lower the rebound.

Although not subject to any particular limitation, from the standpoint of achieving the desired hardnesses in each of the first to third layers, it is recommended that the amounts of the co-crosslinking agent included in the rubber compositions for the respective layers be adjusted so as to satisfy the condition first layer<second layer>third layer.

Commercially available products may be used as the organic peroxide in the rubber composition. For example, preferred use may be made of Percumyl D (produced by NOF Corporation), Perhexa 3M (NOF Corporation), or Luperco 231XL (Atochem Co.). These may be used singly or as a combination of two or more thereof.

The amount of organic peroxide included in the rubber composition, although not subject to any particular limitation, may be set to preferably at least 0.1 part by weight, more preferably at least 0.3 part by weight, even more preferably at least 0.5 part by weight, and most preferably at least 0.7 part by weight, per 100 parts by weight of the base rubber. The maximum organic peroxide content per 100 parts by weight of the base rubber, although not subject to any particular limitation, may be set to preferably not more than 5 parts by weight, more preferably not more than 4 parts by weight, even more preferably not more than 3 parts by weight, and most preferably not more than 2 parts by weight. Too much or too little organic peroxide may make it impossible to obtain a good feel on impact, durability and rebound.

Commercially available products may be used as the antioxidant in the rubber composition. Illustrative examples include Nocrac NS-6 and Nocrac NS-30 (both available from Ouchi Shinko Chemical Industry Co., Ltd.), and Yoshinox 425 (Yoshitomi Pharmaceutical Industries, Ltd.). These may be used singly, or two or more may be used in combination.

The amount of antioxidant included in the rubber composition, although not subject to any particular limitation, can be set to more than 0, and may be set to preferably at least 0.05 part by weight, and more preferably at least 0.1 part by weight, per 100 parts by weight of the base rubber. The maximum antioxidant content, although not subject to any particular limitation, may be set to preferably not more than 3 parts by weight, more preferably not more than 2 parts by weight, even more preferably not more than 1 part by weight, and most preferably not more than 0.5 part by weight. Too much or too little antioxidant may make it impossible to obtain a good rebound and durability.

Preferred use may be made of inert fillers such as zinc oxide, barium sulfate and calcium carbonate in the rubber composition. These may be used singly, or two or more may be used in combination.

The amount of inert filler included in the rubber composition, although not subject to any particular limitation, may be set to preferably at least 1 part by weight, and more preferably at least 5 parts by weight, per 100 parts by weight of the base rubber. The maximum inert filler content per 100 parts by weight of the base rubber, although not subject to any particular limitation, may be set to preferably not more than 50 parts by weight, more preferably not more than 40 parts by weight, even more preferably not more than 30 parts by weight, and most preferably not more than 25 parts by weight. Too much or too little inorganic filler may make it impossible to achieve a suitable weight and a good rebound.

In addition, to enhance rebound by the golf ball and increase the initial velocity of the golf ball, it is preferable for the rubber composition to include an organosulfur compound. In such a case, the organosulfur compound may be included in at least one of the above first to third layers, although it is recommended that it be included in all three layers.

The organosulfur compound is not subject to any particular limitation, provided it is capable of enhancing the golf ball rebound. Preferred use may be made of thiophenols, thionaphthols, halogenated thiophenols, and metal salts thereof. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol, and diphenylpolysulfides, dibenzylpolysulfides, dibenzoylpolysulfides, dibenzothiazoylpolysulfides and dithiobenzoylpolysulfides having 2 to 4 sulfurs. In this invention, of the above, the use of diphenyldisulfide or the zinc salt of pentachlorothiophenol is especially preferred.

The amount of the organosulfur compound included per 100 parts by weight of the base rubber, although not subject to any particular limitation, may be set to preferably at least 0.05 part by weight, more preferably at least 0.1 part by weight, and even more preferably at least 0.2 part by weight. The maximum organosulfur compound content per 100 parts by weight of the base rubber, although not subject to any particular limitation, is preferably not more than 5 parts by weight, more preferably not more than 3 parts by weight, and even more preferably not more than 2.5 parts by weight. Including too little may make it impossible to obtain a sufficient rebound-enhancing effect. If too much is included, the rebound-enhancing effect reaches a peak beyond which no further effect can be expected, in addition to which the core may become too soft, possibly worsening the feel of the ball on impact.

Although not subject to any particular limitation, from the standpoint of imparting the golf ball with a good rebound, it is recommended that the amounts of the organosulfur compound included in the rubber compositions for the respective layers be adjusted so as to satisfy the condition first layer>second layer>third layer.

In the invention, the solid core has a multilayer construction composed of a first layer to a third layer, which respective layers may be formed as described below using the foregoing rubber compositions.

The first layer may be produced by suitably selecting the above-described rubber composition, and effecting vulcanization and curing by a method similar to that used for known golf ball rubber compositions so as to obtain the subsequently indicated cross-sectional hardness. The vulcanization conditions may involve setting the vulcanization temperature to between 100 and 200° C. and setting the vulcanization time to between 10 and 40 minutes. Here, in order to obtain the desired crosslinked rubber body for use as a core in the invention, the vulcanization temperature is preferably at least 150° C., and more preferably at least 155° C., with the upper limit being preferably not more than 200° C., more preferably not more than 190° C., even more preferably not more than 180° C., and most preferably not more than 170° C.

The second layer forming method may be a known method and is not subject to any particular limitation, although preferred use may be made of the following method. First, a second layer-forming material is placed in a predetermined mold and subjected to primary vulcanization (semi-vulcanization) so as to produce a pair of hemispherical half-cups. Then, a prefabricated spherical first layer is enclosed within the half-cups produced as just described, and secondary vulcanization (complete vulcanization) is carried out in this state. That is, advantageous use may be made of a process in which the vulcanization step is divided into two stages. Alternatively, advantageous use may be made of a process in which the second layer-forming material is injection-molded over the first layer.

The method of forming the third layer is not subject to any particular limitation, although preferred use may be made of a method similar to the above-described method of forming the second layer. That is, preferred use may be made of a method in which a third layer-forming material is placed in a predetermined mold and subjected to primary vulcanization (semi-vulcanization) so as to produce a pair of hemispherical half-cups, following which a prefabricated second layer-covered sphere (the sphere obtained by covering the first layer with the second layer) is enclosed within the half-cups produced as just described and secondary vulcanization (complete vulcanization) is carried out in this state, or a method in which a third layer-forming material is injected-molded over the second layer.

The multi-piece solid golf ball of the invention is obtained by forming an intermediate layer and a cover over the above-described solid core having a multilayer construction. In the invention, it is critical for the material hardness of the intermediate layer to be higher than the material hardness of the cover. By having the material hardnesses of the intermediate layer and the cover satisfy this condition, it is possible to increase the distance traveled by the ball on full shots with a driver and for the ball to exhibit a high controllability in the short game.

The intermediate layer and the cover are described in detail below.

The material hardness of the intermediate layer is not subject to any particular limitation, provided it satisfies the above hardness condition. However, the material hardness, expressed as the Shore D hardness, may be set to preferably at least 55, more preferably at least 60, and even more preferably at least 63. The maximum Shore D material hardness, although not subject to any particular limitation, may be set to preferably not more than 75, more preferably not more than 70, and even more preferably not more than 67. If the material hardness of the intermediate layer is too low, the ball may be too receptive to spin on full shots, resulting in a poor distance. On the other hand, if the material hardness is too high, the durability to cracking when repeatedly struck may worsen or the feel of the ball when hit with a putter or on short approach shots may become too hard. As used herein, "material hardness" refers to the hardness of a material when it has been molded into a sheet of a predetermined thickness. The same applies below. "Material hardness" refers here to the hardness of a material when it has been molded into a sheet of a predetermined thickness (the same applies below).

The thickness of the intermediate layer is not subject to any particular limitation, although it is recommended that the intermediate layer be formed so as to be thicker than the subsequently described cover. More specifically, it is recommended that the intermediate layer having a thickness of preferably at least 0.5 mm, more preferably at least 0.7 mm, and even more preferably at least 0.9 mm. The maximum value, although not subject to any particular limitation, is preferably not more than 2.0 mm, more preferably not more than 1.7 mm, and even more preferably not more than 1.4 mm. If the thickness of the intermediate layer is larger than the above range or smaller than the thickness of the subsequently described outer cover layer, the spin rate-lowering effect on full shots with a driver (W#1) may be inadequate, as a result of which a good distance may not be achieved. On the other hand, if the thickness of the intermediate layer is too small, the durability of the ball to cracking when repeatedly struck and the low-temperature durability may worsen.

The material which forms the intermediate layer, although not subject to any particular limitation, may generally be an ionomer resin. Commercial products such as the HIMILAN series available from DuPont-Mitsui Polychemicals Co., Ltd. or the SURLYN series available from E.I. DuPont de Nemours & Co. may be used as the ionomer resin.

These ionomer resins may be used singly or as combinations of two or more types. In the invention, from the standpoint of increasing the rebound of the ball, it is especially preferable to use a combination of a zinc-neutralized ionomer resin with a sodium-neutralized ionomer resin. In such a case, the compounding ratio by weight between the zinc-neutralized ionomer resin and the sodium-neutralized ionomer resin, although not subject to any particular limitation, may be set to generally between 25:75 and 75:25, preferably between 35:65 and 65:35, and more preferably between 45:55 and 55:45. At a compounding ratio outside of the above range, the rebound may become too low, making it impossible to obtain the desired flight performance, the durability to cracking when repeatedly struck at ordinary temperatures may worsen, and the durability to cracking at low (subzero Celsius) temperatures may worsen.

In addition, various additives may optionally be included in the material for forming this intermediate layer. For example, additives such as pigments, dispersants, antioxidants, light stabilizers, ultraviolet absorbers and parting agents may be suitably included.

The method of forming the intermediate layer is not subject to any particular limitation, although a known method may be employed for this purpose. For example, use may be made of a method that involves injection-molding an intermediate layer-forming material over the solid core, or a method that involves prefabricating a pair of hemispherical half-cups from the intermediate layer-forming material, then enclosing the solid core within these half-cups and molding under heat and pressure at 140 to 180° C. for 2 to 10 minutes.

Next, the cover is described. As used here in connection with the present invention, the term 'cover' refers to the outermost layer of the ball and excludes the intermediate layer described above.

The material hardness of the cover is not subject to any particular limitation, provided the above hardness conditions are satisfied. However, the Shore D hardness may be set to preferably at least 30, more preferably at least 40, and even more preferably at least 43. The maximum Shore D hardness, although not subject to any particular limitation, may be set to preferably not more than 60, more preferably not more than 50, and even more preferably not more than 47. If the material hardness of the cover is too low, the ball may be too receptive to spin on full shots, resulting in a poor distance. On the other hand, if the material hardness is too high, the ball may not be receptive to spin on approach shots, as a result of which the controllability may be inadequate even for professional golfers and skilled amateur golfers.

The thickness of the cover is not subject to any particular limitation, although it is recommended that the cover be formed so as to be thinner than the intermediate layer. More specifically, it is recommended that the cover thickness be set to preferably at least 0.3 mm, more preferably at least 0.5 mm, and even more preferably at least 0.7 mm. The maximum value, although not subject to any particular limitation, may be set to preferably not more than 1.5 mm, more preferably not more than 1.2 mm, and even more preferably not more than 1.0 mm. At a cover thickness larger than the above range, the ball rebound when struck with a driver (W#1) may be inadequate or the spin rate may be too high, as a result of which a good distance may not be obtained. On the other hand, if the cover thickness is smaller than the above range, the ball may have a poor scuff resistance or may have an inadequate controllability even for professional golfers and skilled amateur golfers.

The cover is not subject to any particular limitation. However, from the standpoint of controllability and scuff resistance, the cover is preferably formed using a polyurethane material. Of such materials, in terms of amenability to mass production, the use of a thermoplastic polyurethane is especially preferred. More specifically, preferred use may be made of a material containing (A) a thermoplastic polyurethane and (B) an isocyanate compound.

To fully achieve the advantageous effects of the invention, a necessary and sufficient amount of unreacted isocyanate groups should be present within the cover resin material. Specifically, it is recommended that the combined weight of above component A and component B be preferably at least 60%, and more preferably at least 70%, of the weight of the overall cover layer. Above components A and B are described in detail below.

The thermoplastic polyurethane serving as component A has a structure which includes soft segments composed of a polymeric polyol that is a long-chain polyol (polymeric glycol), and hard segments composed of a chain extender and an isocyanate compound. Here, the long-chain polyol used as a starting material is not subject to any particular limitation, and may be any that is used in the prior art relating to thermoplastic polyurethanes. Exemplary long-chain polyols include polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. These long-chain polyols may be used singly or as combinations of two or more thereof. Of the long-chain polyols mentioned here, polyether polyols are preferred because they enable the synthesis of thermoplastic polyurethanes having a high rebound resilience and excellent low-temperature properties.

Illustrative examples of the above polyether polyol include poly(ethylene glycol), poly(propylene glycol), poly(tetramethylene glycol) and poly(methyltetramethylene glycol) obtained by the ring-opening polymerization of a cyclic ether. The polyether polyol may be used singly or as a combination of two or more thereof. Of these, preferred use may be made of poly(tetramethylene glycol) and/or poly(methyltetramethylene glycol).

It is preferable for these long-chain polyols to have a number-average molecular weight which, although not subject to any particular limitation, is in the range of 1,500 to 5,000. By using a long-chain polyol having a number-average molecular weight within this range, golf balls made of a thermoplastic polyurethane composition having excellent properties such as the above-described resilience and manufacturability can be reliably obtained. The number-average molecular weight of the long-chain polyol is more preferably in the range of 1,700 to 4,000, and even more preferably in the range of 1,900 to 3,000.

As used herein, "number-average molecular weight of the long-chain polyol" refers to the number-average molecular weight computed based on the hydroxyl number measured in accordance with JIS K-1557.

The chain extender used, although not subject to any particular limitation, is preferably one employed in the prior art relating to thermoplastic polyurethanes. For example, use may be made of a low-molecular-weight compound which has a molecular weight of 400 or less and includes on the molecule two or more active hydrogen atoms capable of reacting with isocyanate groups. Of these, the use of an aliphatic diol having 2 to 12 carbons is preferred. Illustrative examples include 1,4-butylene glycol, 1,2-ethylene glycol, 1,3-butanediol, 1,6-hexanediol and 2,2-dimethyl-1,3-propanediol. Of these, the use of 1,4-buylene glycol is especially preferred.

The isocyanate compound is not subject to any particular limitation; preferred use may be made of one that is employed in the prior art relating to thermoplastic polyurethanes. Specific examples include one or more selected from the group consisting of 4,4'-diphenylmethane diisocyanate, 2,4-toluene diisocyanate, 2,6-toluene diisocyanate, p-phenylene diisocyanate, xylylene diisocyanate, naphthylene-1,5-diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. Depending on the type of isocyanate used, the crosslinking reaction during injection molding may be difficult to control. In the practice of the invention, to provide a balance between stability at the time of production and the properties that are manifested, it is most preferable to use 4,4'-diphenylmethane diisocyanate, which is an aromatic diisocyanate.

It is most preferable for the thermoplastic polyurethane serving as above component A to be a thermoplastic polyurethane synthesized using a polyether polyol as the long-chain polyol, using an aliphatic diol as the chain extender, and using an aromatic diisocyanate as the isocyanate compound. It is desirable, though not essential, for the polyether polyol to be a polytetramethylene glycol having a number-average molecular weight of at least 1,900, for the chain extender to be 1,4-butylene glycol, and for the aromatic diisocyanate to be 4,4'-diphenylmethane diisocyanate.

The ratio of active hydrogen atoms to isocyanate groups in the above polyurethane-forming reaction can be controlled within a desirable range so as to make it possible to obtain a golf ball which is composed of a thermoplastic polyurethane composition and has various improved properties, such as rebound, spin performance, scuff resistance and manufacturability. Specifically, in preparing a thermoplastic polyurethane by reacting the above long-chain polyol, isocyanate compound and chain extender, it is desirable to use the respective components in proportions such that the amount of isocyanate groups on the isocyanate compound per mole of active hydrogen atoms on the long-chain polyol and the chain extender is between 0.95 and 1.05 moles.

No particular limitation is imposed on the method of preparing component A. Production may be carried out by a prepolymer process or a one-shot process which uses a long-chain polyol, a chain extender and an isocyanate compound, and employs a known urethane-forming reaction. Of these, a process in which melt polymerization is carried out in a substantially solvent-free state is preferred. Production by continuous melt polymerization using a multiple screw extruder is especially preferred.

A commercially available product may be used as component A. Illustrative examples include Pandex T-8295, Pandex T-8290, Pandex T-8260, Pandex T-8295 and Pandex T-8290 (all available from DIC Bayer Polymer, Ltd.).

Next, it is critical that the isocyanate compound serving as component B have two or more isocyanate groups. Moreover, in this invention, a sufficient amount of unreacted isocyanate groups to fully achieve the advantageous effects of the invention should be present in the cover-forming resin material. That is, isocyanate compound in which all the isocyanate groups on the compound are in an unreacted state may be present together with isocyanate compound in which some or all of the isocyanate groups have reacted.

Various types of isocyanates may be employed without particular limitation as this isocyanate compound. Illustrative examples include one or more selected from the group consisting of 4,4'-diphenylmethane diisocyanate, 2,4-toluene diisocyanate, 2,6-toluene diisocyanate, p-phenylene diisocyanate, xylylene diisocyanate, naphthylene-1,5-diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. Of the above group of isocyanates, the use of 4,4'-diphenylmethane diisocyanate, dicyclohexylmethane diisocyanate and isophorone diisocyanate is preferable in terms of the balance between the influence on processability of such effects as the rise in viscosity that accompanies the reaction with the thermoplastic polyurethane serving as component A and the physical properties of the resulting golf ball cover material.

In the practice of the invention, although not an essential constituent, a thermoplastic elastomer other than the above-described thermoplastic polyurethane may be included as component C together with components A and B. Incorporating this component C in the above resin blend enables the flow properties of the resin blend to be further improved and enables increases to be made in various properties required of golf ball cover materials, such as resilience and scuff resistance.

The relative proportions of above components A, B and C are not subject to any particular limitation, although to fully achieve the advantageous effects of the invention, it is preferable for the weight ratio A:B:C of the respective components to be from 100:2:50 to 100:50:0.

In the practice of the invention, the resin blend is prepared by mixing together component A, component B and also, if necessary, component C. It is critical to select the mixing conditions such that, of the isocyanate compound, at least some isocyanate compound is present in which all the isocyanate groups on the molecule remain in an unreacted state. For example, treatment such as purging with an inert gas (e.g., nitrogen) or vacuum treatment must be furnished. The resin blend is then injection-molded over a core which has been placed in a mold. For smooth and easy handling, it is preferable for the resin blend to be formed into pellets having a length of 1 to 10 mm and a diameter of 0.5 to 5 mm. Isocyanate groups in an unreacted state remain in these resin pellets; the unreacted isocyanate groups react with component A or component C to form a crosslinked material while the resin blend is being injection-molded over the core, or due to post-treatment such as annealing.

Various additives such as pigments, dispersants, antioxidants, ultraviolet absorbers, ultraviolet stabilizers, parting agents, plasticizers, and inorganic fillers (e.g., zinc oxide, barium sulfate, titanium dioxide) may be optionally included in the above-described cover material.

The melt mass flow rate (MFR) at 210° C. of the resin blend is not subject to any particular limitation. However, to increase the flow properties and manufacturability, the MFR is preferably at least 5 g/10 min, more preferably at least 20 g/10 min, and even more preferably at least 50 g/10 min. If the melt mass flow rate for the resin blend is too small, the flow properties will decrease, which may cause eccentricity during injection molding and may also lower the degree of freedom in the cover thickness. The melt mass flow rate is measured in accordance with JIS K 7210-1999.

An example of a method which may be employed to mold the cover involves feeding the above resin blend to an injection molding machine, and injecting the molten resin blend over the core. Although the molding temperature in this case will vary depending on the type of thermoplastic polyurethane, the molding temperature is generally in the range of 150 to 250° C.

When injection molding is carried out, it is desirable, though not essential, to render the interior of the resin paths from the resin feed area to the mold interior into a low-humidity environment by subjecting some or all places on these resin paths to purging with an inert gas such as nitrogen or a low-moisture gas such as low dew-point dry air, or to vacuum treatment. Preferred, non-limiting, examples of the medium used for transporting the resin under applied pressure include inert gases such as nitrogen and low-humidity gases such as low dew-point dry air. By molding the cover in such a low-humidity environment, reaction by the isocyanate groups is suppressed as much as possible in the period until the resin blend is charged into the mold interior. As a result, the resin blend has a stable viscosity and an improved moldability, in addition to which the real crosslinking efficiency can be enhanced.

By forming the cover in the above manner, a distance-increasing effect is obtained, in addition to which the spin performance on approach shots improves, enabling both controllability and distance to be achieved.

When forming the above cover, although not subject to any particular limitation, to increase adhesion with the cover, it is desirable to abrade the surface of the intermediate layer beforehand. In addition, it is preferable to apply a primer (adhesive) to the surface of the intermediate layer following such abrasion or to add an adhesion reinforcing agent to the cover-forming material. Examples of adhesion reinforcing agents that may be included in the cover-forming material include organic compounds such as 1,3-butanediol and trimethylolpropane, and oligomers such as polyethylene glycol and polyhydroxy polyolefin oligomers. The use of trimethylolpropane or a polyhydroxy polyolefin oligomer is especially preferred. Examples of commercial products include trimethylolpropane available from Mitsubishi Gas Chemical Co., Ltd. and polyhydroxy polyolefin oligomers available from Mitsubishi Chemical Corporation (under the trade name "Polytail H"; number of main-chain carbons, 150 to 200; hydroxy-terminated).

The diameter of the golf ball in which the above-described core and cover have been formed should accord with golf ball standards, and is preferably not less than 42.67 mm. The maximum value, although not subject to any particular limitation, may be set to preferably not more than 44 mm, more preferably not more than 43.8 mm, even more preferably not more than 43.5 mm, and most preferably not more than 43 mm.

In the golf ball of the invention, as in conventional golf balls, numerous dimples may be formed on the surface of the cover in order to further increase the aerodynamic properties and extend the distance traveled by the ball. In such cases, the number of dimples formed on the ball surface, although not subject to any particular limitation, is preferably at least 280, more preferably at least 300, and even more preferably at least 320. The maximum number of dimples, although not subject to any particular limitation, may be set to preferably not more than 360, more preferably not more than 350, and even more preferably not more than 340. If the number of dimples is larger than the above range, the trajectory of the ball may become low, as a result of which a good distance may not be achieved. On the other hand, if the number of dimples is smaller than the above range, the trajectory may become high, as a result of which an increased distance may not be achieved.

The geometric arrangement of the dimples on the ball may be, for example, octahedral or icosahedral. In addition, the dimple shapes may be of one, two or more types suitably selected from among not only circular shapes, but also various polygonal shapes, such as square, hexagonal, pentagonal and triangular shapes, as well as dewdrop shapes and oval shapes. The diameter (in polygonal shapes, the lengths of the diagonals), although not subject to any particular limitation, is preferably set to from 2.5 to 6.5 mm. In addition, the depth, although not subject to any particular limitation, is preferably set to from 0.08 to 0.30 mm.

In this invention, the value $V_0$, defined as the spatial volume of a dimple below the flat plane circumscribed by the dimple edge, divided by the volume of the cylinder whose base is the flat plane and whose height is the maximum depth of the dimple from the base, although not subject to any particular limitation, may be set to from 0.35 to 0.80.

From the standpoint of reducing aerodynamic resistance, the ratio SR of the sum of individual dimple surface areas, each defined by the flat plane circumscribed by the edge of a dimple, with respect to the surface area of the ball sphere were the ball surface to have no dimples thereon, although not subject to any particular limitation, is preferably set to from 60 to 90%. This ratio SR can be elevated by increasing the number of dimples formed, and also by intermingling dimples of a plurality of types of different diameters or by giving the dimples shapes such that the distance between neighboring dimples (i.e., the land width) becomes substantially 0.

The ratio VR of the sum of the spatial volumes of individual dimples, each formed below the flat plane circumscribed by the edge of a dimple, with respect to the volume of the ball sphere were the ball surface to have no dimples thereon, although not subject to any particular limitation, is preferably set to from 0.6 to 1% in this invention.

In this invention, by setting the above $V_0$, SR and VR values in the foregoing ranges, the aerodynamic resistance is reduced, in addition to which a trajectory enabling a good distance to be achieved readily arises and the flight performance can be enhanced.

The surface of the ball cover may be subjected to various types of treatment, such as surface preparation, stamping and painting, in order to enhance the design and durability of the golf ball.

As explained above, the present invention, by optimizing the hardness relationships among the various layers of the above-described core having a multilayer structure and the hardness relationship between the intermediate layer and the cover, enables a multi-piece solid golf ball to be obtained which has an increased distance, particularly on full shots with a driver (W#1), and an improved controllability in the short game, and moreover which is able on full shots to confer an agreeable feel at impact characterized by a solid sensation that includes a soft touch.

EXAMPLES

Examples of the invention and Comparative Examples are given below by way of illustration, and not by way of limitation.

Examples 1 to 3, Comparative Examples 1 to 5

The rubber compositions shown in Table 1 below were prepared using a roll mill, then molded and vulcanized at 155° C. for 15 minutes to produce a spherical molding as the first layer.

To form the second layer, in the respective examples, first a pair of hemispherical half-cups was fabricated by preparing the rubber composition shown in Table 2 using a roll mill, then carrying out primary vulcanization (semi-vulcanization) at 35° C. for 3 minutes. Next, the first layer was enclosed within the resulting half-cups and the second layer was formed by secondary vulcanization (complete vulcanization) in a mold at 155° C. for 15 minutes, thereby producing a sphere composed of the first layer encased by the second layer (second-layer-covered sphere).

The third layer was formed in the same way as the second layer. That is, first, the rubber composition shown in Table 3 was prepared using a roll mill, then subjected to primary vulcanization (semi-vulcanization) at 35° C. for 3 minutes, thereby fabricating a pair of hemispherical half-cups. Next, the second layer-covered sphere was enclosed within the resulting half-cups and the entire body was subjected to secondary vulcanization (complete vulcanization) at 155° C. for 15 minutes in a mold to form the third layer, thereby producing a solid core having a three-layer construction. Details on the solid core thus produced are shown in Table 4.

TABLE 1

| Formulation | Example | | | Comparative Example | | | | |
|---|---|---|---|---|---|---|---|---|
| (pbw) | 1 | 2 | 3 | 1 | 2 | 3 | 4 | 5 |
| Polybutadiene rubber | 100 | 100 | 100 | 100 | 100 | 100 | 100 | 100 |
| Zinc acrylate | 17.0 | 22.0 | 17.0 | 22.0 | 35.0 | 22.0 | 22.0 | 22.0 |
| Peroxide | 1.2 | 1.2 | 1.2 | 1.2 | 1.2 | 1.2 | 1.2 | 1.2 |
| Antioxidant | 0.1 | 0.1 | 0.1 | 0.1 | 0.1 | 0.1 | 0.1 | 0.1 |
| Zinc oxide | 16.4 | 14.2 | 16.4 | 14.2 | 9.8 | 14.2 | 14.2 | 14.2 |
| Zinc salt of pentachloro-thiophenol | 2.5 | 2.5 | 2.5 | 2.5 | 0.5 | 2.5 | 2.5 | 2.5 |
| Zinc stearate | 5 | 5 | 5 | 5 | 5 | 5 | 5 | 5 |

TABLE 2

| Formulation | Example | | | Comparative Example | | | | |
|---|---|---|---|---|---|---|---|---|
| (pbw) | 1 | 2 | 3 | 1 | 2 | 3 | 4 | 5 |
| Polybutadiene rubber | 100 | 100 | 100 | 100 | 100 | 100 | 100 | 100 |
| Zinc acrylate | 35.0 | 35.0 | 35.0 | 35.0 | 35.0 | 35.0 | 35.0 | 35.0 |
| Peroxide | 1.2 | 1.2 | 1.2 | 1.2 | 1.2 | 1.2 | 1.2 | 1.2 |
| Antioxidant | 0.1 | 0.1 | 0.1 | 0.1 | 0.1 | 0.1 | 0.1 | 0.1 |
| Zinc oxide | 13.0 | 13.0 | 13.0 | 13.0 | 13.0 | 14.2 | 13.0 | 13.0 |
| Zinc salt of pentachloro-thiophenol | 2.0 | 2.0 | 2.0 | 2.0 | 2.0 | 2.0 | 2.0 | 2.0 |
| Zinc stearate | 5 | 5 | 5 | 5 | 5 | 5 | 5 | 5 |

TABLE 3

| Formulation | Example | | | Comparative Example | | | | |
|---|---|---|---|---|---|---|---|---|
| (pbw) | 1 | 2 | 3 | 1 | 2 | 3 | 4 | 5 |
| Polybutadiene rubber | 100 | 100 | 100 | 100 | 100 | — | 100 | 100 |
| Zinc acrylate | 30.0 | 26.0 | 26.0 | 39.0 | 26.0 | — | 26.0 | 30.0 |
| Peroxide | 1.2 | 1.2 | 1.2 | 1.2 | 1.2 | — | 1.2 | 1.2 |
| Antioxidant | 0.1 | 0.1 | 0.1 | 0.1 | 0.1 | — | 0.1 | 0.1 |
| Zinc oxide | 20.4 | 22.0 | 22.0 | 16.7 | 22.0 | — | 22.0 | 20.4 |
| Zinc salt of pentachloro-thiophenol | 0.4 | 0.4 | 0.4 | 0.4 | 0.4 | — | 0.4 | 0.4 |
| Zinc stearate | 0 | 0 | 0 | 0 | 0 | — | 0 | 0 |

Details on the materials in Tables 1 to 3 are given below.

Polybutadiene rubber:

Available as "BR 730" from JSR Corporation. A polybutadiene rubber obtained using a neodymium catalyst; cis-1,4 bond content, 96 wt %; Mooney viscosity, 55; molecular weight distribution, 3.

Zinc acrylate: Available from Nihon Jyoryu Kogyo Co., Ltd.

Organic peroxide: Available as "Perhexa C-40" from NOF Corporation. 1,1-Bis(t-butylperoxy)cyclo-hexane diluted to 40% with an inorganic filler. Half-life at 155° C., about 50 seconds.

Antioxidant: Available as "Nocrac NS-6" from Ouchi Shinko Chemical Industry Co., Ltd.

Zinc oxide: Available from Sakai Chemical Co., Ltd.

Next, an intermediate layer was formed by injection molding a resin material of the composition shown in Table 5 over the respective solid cores fabricated as described above, thereby giving spheres composed of a solid core encased by an intermediate layer (intermediate layer-covered sphere). Next, a cover was formed over this sphere by injection-molding a resin material of the composition indicated as No. 5 in Table 5, thereby giving a multi-piece solid golf ball having a solid core with a three-layer construction encased by an intermediate layer and a cover. In Examples 1 to 3 and Comparative Examples 1 to 4, the respective starting materials indicated for No. 4 in Table 5 were mixed in a screw extruder under a nitrogen atmosphere to give a cover-forming resin blend (in the form of pellets having a length of 3 mm and a diameter of 1 to 2 mm), following which the cover was formed by injection molding. Dimples having the arrangement shown in FIG. 1 were formed at this time on the surface of the ball cover in all of the examples according to the invention and the comparative examples. Details on the dimples are shown in Table 6. Details of the balls produced are shown in Table 7.

TABLE 5

| | Formulation (parts by weight) | | | | |
|---|---|---|---|---|---|
| | No. 1 | No. 2 | No. 3 | No. 4 | No. 5 |
| Himilan AM7317 | 50 | | | | |
| Himilan AM7318 | 50 | | | | |
| Surlyn 8320 | | 100 | | | |

TABLE 4

| | | | Example | | | Comparative Example | | | | |
|---|---|---|---|---|---|---|---|---|---|---|
| | | | 1 | 2 | 3 | 1 | 2 | 3 | 4 | 5 |
| First layer | Material | | rubber | rubber | rubber | rubber | rubber | rubber | rubber | rubber |
| | Diameter (mm) | | 20.0 | 20.0 | 20.0 | 20.0 | 20.0 | 20.0 | 20.0 | 20.0 |
| | Weight (g) | | 4.7 | 4.7 | 4.7 | 4.7 | 4.7 | 4.7 | 4.7 | 4.7 |
| | Specific gravity | | 1.12 | 1.12 | 1.12 | 1.12 | 1.12 | 1.12 | 1.12 | 1.12 |
| | Deflection (mm) | | 6.8 | 6.0 | 6.8 | 6.0 | 4.0 | 6.0 | 6.0 | 6.8 |
| | Cross-sectional hardness (a) | (JIS-C) | 50 | 55 | 50 | 55 | 65 | 55 | 55 | 50 |
| | | (Shore D) | 30 | 34 | 30 | 34 | 41 | 34 | 34 | 30 |
| | Surface hardness (b) | (JIS-C) | 60 | 68 | 60 | 68 | 88 | 68 | 68 | 60 |
| | | (Shore D) | 38 | 44 | 38 | 44 | 59 | 44 | 44 | 38 |
| Second layer | Material | | rubber | rubber | rubber | rubber | rubber | rubber | rubber | rubber |
| | Thickness (mm) | | 7.85 | 7.85 | 7.85 | 7.85 | 7.85 | 9.35 | 7.85 | 7.85 |
| | Specific gravity | | 1.14 | 1.14 | 1.14 | 1.14 | 1.14 | 1.15 | 1.14 | 1.14 |
| | Surface hardness (c) | (JIS-C) | 84 | 84 | 84 | 84 | 84 | 84 | 84 | 84 |
| | | (Shore D) | 56 | 56 | 56 | 56 | 56 | 56 | 56 | 56 |
| | Diameter of second layer-covered sphere (mm) | | 35.7 | 35.7 | 35.7 | 35.7 | 35.7 | 38.7 | 35.7 | 35.7 |
| | Weight of second layer-covered sphere (g) | | 27.1 | 27.1 | 27.1 | 27.1 | 27.1 | 34.7 | 27.1 | 27.1 |
| Third layer | Material | | rubber | rubber | rubber | rubber | rubber | — | rubber | rubber |
| | Thickness (mm) | | 1.5 | 1.5 | 1.5 | 1.5 | 1.5 | — | 1.5 | 1.5 |
| | Specific gravity | | 1.17 | 1.17 | 1.17 | 1.17 | 1.17 | — | 1.17 | 1.17 |
| | Surface hardness (d) | (JIS-C) | 78 | 74 | 74 | 87 | 74 | — | 74 | 78 |
| | | (Shore D) | 51 | 49 | 49 | 58 | 49 | — | 49 | 51 |
| | Weight of solid core (g) | | 38.7 | 38.7 | 38.7 | 38.7 | 38.7 | — | 38.7 | 38.7 |
| | Diameter of solid core (mm) | | 34.7 | 34.7 | 34.7 | 34.7 | 34.7 | — | 34.7 | 34.7 |
| Hardness relationships | (b) − (a) (JIS-C) | | 10 | 13 | 10 | 13 | 23 | 13 | 13 | 10 |
| | (c) − (a) (JIS-C) | | 34 | 29 | 34 | 29 | 19 | 29 | 29 | 34 |
| | (c) − (b) (JIS-C) | | 24 | 16 | 24 | 16 | −4 | 16 | 16 | 24 |
| | (d) − (c) (JIS-C) | | −6 | −9 | −10 | 3 | −9 | — | −9 | −6 |
| | (d) − (a) (JIS-C) | | 28 | 19 | 24 | 32 | 9 | — | 19 | 28 |

TABLE 5-continued

| | Formulation (parts by weight) | | | | |
|---|---|---|---|---|---|
| | No. 1 | No. 2 | No. 3 | No. 4 | No. 5 |
| Himilan 1557 | | | 50 | | |
| Himilan 1601 | | | 50 | | |
| Trimethylolpropane | 1.1 | 1.1 | 1.1 | | |
| Pandex T-8290 | | | | 37.5 | |
| Pandex T-8283 | | | | 62.5 | |
| Pandex T-8260 | | | | | 100 |
| Titanium oxide | | | | 3.5 | 3.5 |
| Polyethylene wax | | | | 1.5 | 1.5 |
| Isocyanate compound | | | | 9 | 9 |

Details on the materials in Table 5 are given below.

Himilan: Ionomer resins available from DuPont-Mitsui Polychemicals Co., Ltd.

Surlyn: An ionomer resin available from E.I. DuPont de Nemours and Co.

Pandex: A MDI-PTMG type thermoplastic polyurethane available from DIC Bayer Polymer Titanium oxide: Available as "Tipaque R680" from Ishihara Sangyo Kaisha, Ltd.

Polyethylene wax: Available as "Sanwax 161P" from Sanyo Chemical Industries, Ltd.

Isocyanate compound: 4,4'-Diphenylmethane diisocyanate

TABLE 6

| No. | Number of dimples | Diameter (mm) | Depth (mm) | $V_0$ | SR (%) | VR (%) |
|---|---|---|---|---|---|---|
| 1 | 12 | 4.6 | 0.15 | 0.47 | 81 | 0.78 |
| 2 | 234 | 4.4 | 0.15 | 0.47 | | |
| 3 | 60 | 3.8 | 0.14 | 0.47 | | |
| 4 | 6 | 3.5 | 0.13 | 0.46 | | |
| 5 | 6 | 3.4 | 0.13 | 0.46 | | |
| 6 | 12 | 2.6 | 0.10 | 0.46 | | |
| Total | 330 | | | | | |

Dimple Definitions

Diameter: Diameter of flat plane circumscribed by edge of dimple.

Depth: Maximum depth of dimple from flat plane circumscribed by edge of dimple.

$V_0$: Spatial volume of dimple below flat plane circumscribed by dimple edge, divided by volume of cylinder whose base is the flat plane and whose height is the maximum depth of dimple from the base.

SR: Sum of individual dimple surface areas, each defined by the flat plane circumscribed by the edge of the dimple, as a percentage of the surface area of a hypothetical sphere were the ball to have no dimples on the surface thereof (units: %).

VR: Sum of spatial volumes of individual dimples formed below flat plane circumscribed by the edge of the dimple, as a percentage of the volume of a hypothetical sphere were the ball to have no dimples on the surface thereof (units: %).

The following properties were investigated for the golf balls obtained. Also, flight tests were carried out by the following methods, in addition to which the feel on impact was evaluated. The results are shown in Table 7.

Cross-Sectional and Surface Hardnesses of Solid Core (JIS-C Hardnesses)

To determine the cross-sectional hardness of the solid core, the core was cut into two through the center and measurement was carried out by perpendicularly pressing the indenter of a spring-type durometer (JIS type C), as stipulated in JIS K 6301-1975, against the cut face at predetermined positions.

To determine the surface hardness of the solid core, measurement was carried out by perpendicularly pressing the indenter of a spring-type durometer (JIS type C), as stipulated in JIS K 6301-1975, against the surface of the spherical core.

The above hardnesses are all measured values obtained after first holding the solid core isothermally at 23° C.

The specific places where measurement of the cross-sectional and surface hardnesses was carried out were as follows.

(a) center of core (b) surface of first layer (c) surface of second layer (d) surface of third layer Material Hardnesses of Intermediate Layer and Cover (Shore D Hardnesses)

The material hardnesses of the intermediate layer and the cover were values obtained by stacking three measurement samples of the cover material molded in the form of 2 mm thick sheets, and taking measurements with a type D durometer according to ASTM D2240.

Flight Performance on Shots with W#1

A driver (W#1) was mounted on a golf swing robot, and the spin rate (rpm), carry (m) and total distance (m) when the ball was struck at a head speed (HS) of 45 m/s was measured. The club used was a TourStage X-Drive 705, TYPE 415 driver (2011 model; loft, 9.5°) manufactured by Bridgestone Sports Co., Ltd. The flight performance was rated according to the following criteria.

Good: 230 m or more

NG: less than 230 m

Feel

The feel of the ball when hit with a driver (W#1) at a head speed (HS) of 43 to 50 m/s was rated by ten skilled amateur golfers. The rating criteria were as follows.

Good: At least seven out of the ten golfers rated the ball as having a good feel that is solid but includes a soft touch.

NG: Six of fewer of the ten golfers rated the ball as having a good feel.

Spin on Approach Shots

A sand wedge (SW) was mounted on a golf swing robot, and the spin rate (rpm) when the ball was struck at a head speed (HS) of 20 m/s was measured. The club used was a TourStage X-WEDGE (loft, 56°) manufactured by Bridgestone Sports Co., Ltd. The flight performance was rated according to the following criteria.

Good: The spin rate on approach shots was 5,900 rpm or more

NG: The spin rate on approach shots was less than 5,900 rpm

TABLE 7

| | | Example | | | Comparative Example | | | | |
|---|---|---|---|---|---|---|---|---|---|
| | | 1 | 2 | 3 | 1 | 2 | 3 | 4 | 5 |
| Intermediate layer | Material | No. 1 | No. 1 | No. 1 | No. 1 | No. 1 | No. 1 | No. 2 | No. 3 |
| | Thickness (mm) | 1.0 | 1.0 | 1.0 | 1.0 | 1.0 | 1.0 | 1.0 | 1.0 |
| | Specific gravity | 0.95 | 0.95 | 0.95 | 0.95 | 0.95 | 0.95 | 0.95 | 0.95 |
| | Material hardness (Shore D) | 65 | 65 | 65 | 65 | 65 | 65 | 36 | 60 |

TABLE 7-continued

| | | | Example | | | Comparative Example | | | | |
|---|---|---|---|---|---|---|---|---|---|---|
| | | | 1 | 2 | 3 | 1 | 2 | 3 | 4 | 5 |
| | Diameter of intermediate layer-covered sphere (mm) | | 40.7 | 40.7 | 40.7 | 40.7 | 40.7 | 40.7 | 40.7 | 40.7 |
| | Weight of intermediate layer-covered sphere (g) | | 39.4 | 39.4 | 39.4 | 39.4 | 39.4 | 39.4 | 39.4 | 39.4 |
| Cover | Material | | No. 4 | No. 4 | No. 4 | No. 4 | No. 4 | No. 4 | No. 4 | No. 5 |
| | Thickness (mm) | | 0.8 | 0.8 | 0.8 | 0.8 | 0.8 | 0.8 | 0.8 | 0.8 |
| | Specific gravity | | 1.12 | 1.12 | 1.12 | 1.12 | 1.12 | 1.12 | 1.12 | 1.12 |
| | Material hardness (Shore D) | | 44 | 44 | 44 | 44 | 44 | 44 | 44 | 63 |
| | Ball diameter (mm) | | 42.7 | 42.7 | 42.7 | 42.7 | 42.7 | 42.7 | 42.7 | 42.7 |
| | Ball weight (g) | | 45.5 | 45.5 | 45.5 | 45.5 | 45.5 | 45.5 | 45.5 | 45.5 |
| Evaluation of performance | Flight performance (W#1) | Spin rate (rpm) | 2835 | 2959 | 2933 | 2755 | 3164 | 2801 | 3059 | 2653 |
| | | Carry (m) | 212.5 | 213.2 | 213.1 | 212.4 | 211.0 | 212.5 | 204.5 | 210.3 |
| | | Total distance (m) | 233.7 | 231.8 | 232.5 | 234.4 | 224.2 | 233.9 | 219.3 | 231.2 |
| | | Rating | good | good | good | good | NG | good | NG | good |
| | Feel | | good | good | good | NG | NG | NG | good | good |
| | Spin rate on approach shots | Spin rate (rpm) | 6164 | 6088 | 6122 | 6221 | 6298 | 6205 | 5988 | 4789 |
| | | Rating | good | good | good | good | good | good | good | NG |

The invention claimed is:

1. A multi-piece solid golf ball comprising a solid core having a spherical first layer, a second layer encasing the first layer and a third layer encasing the second layer, and an intermediate layer and a cover which encase the solid core, wherein the first to third layers of the solid core are each respectively formed of a rubber composition; letting (a) represent a JIS-C cross-sectional hardness at a center of the first layer on a cross-section obtained by cutting the solid core in half, (b) represent a JIS-C surface hardness of the first layer, (c) represent a JIS-C surface hardness of the second layer and (d) represent a JIS-C surface hardness of the third layer, the hardnesses (a) to (d) satisfy the condition cross-sectional hardness ($a$)<surface hardness ($b$)<surface hardness ($c$)>surface hardness ($d$);

and the intermediate layer and the cover have Shore D material hardnesses which satisfy the condition intermediate layer>cover, wherein an organosulfur compound is included in each of the rubber compositions that form the first to third layers, the organosulfur compound being included in amounts which satisfy the condition first layer>second layer>third layer.

2. The multi-piece solid golf ball of claim 1, wherein the third layer has a thickness of not more than 3 mm.

3. The multi-piece solid golf ball of claim 1, wherein the cross-sectional hardness (a) and the surface hardness (b) satisfy the condition $5 \leq$ surface hardness ($b$)−cross-sectional hardness ($a$)$\leq 20$.

4. The multi-piece solid golf ball of claim 1, wherein the surface hardness (c) and the cross-sectional hardness (a) satisfy the condition $21 \leq$ surface hardness ($c$)−cross-sectional hardness ($a$)$\leq 50$.

5. The multi-piece solid golf ball of claim 1, wherein the surface hardness (c) and the surface hardness (d) satisfy the condition $-20 \leq$ surface hardness ($d$)−surface hardness ($c$)$\leq -1$.

6. The multi-piece solid golf ball of claim 1, wherein zinc acrylate is included in each of the rubber compositions that form the first to third layers, the zinc acrylate being included in amounts which satisfy the condition first layer<second layer>third layer.

7. The multi-piece solid golf ball of claim 6, wherein the amount of zinc acrylate included in each of the rubber compositions is at least 10 parts by weight per 100 parts by weight of the base rubber.

* * * * *